US005242287A

United States Patent [19]

Fujiwawa

[11] Patent Number: 5,242,287

[45] Date of Patent: Sep. 7, 1993

[54] AXIAL FLOW FLUID COMPRESSOR

[75] Inventor: Takayoshi Fujiwawa, Kanagawa, Japan

[73] Assignee: Kabushiki Kaisha Toshiba, Kawasaki, Japan

[21] Appl. No.: 902,982

[22] Filed: Jun. 23, 1992

[30] Foreign Application Priority Data

Jun. 24, 1991 [JP] Japan ..... 3-151343

[51] Int. Cl.[5] ..... F04C 18/32

[52] U.S. Cl. ..... 418/220; 417/356

[58] Field of Search ..... 417/355, 356; 418/220, 418/188

[56] References Cited

U.S. PATENT DOCUMENTS

| | | | |
|---|---|---|---|
| 2,195,902 | 4/1940 | Pezzillo | 417/356 |
| 3,273,506 | 9/1966 | Jamieson | 417/356 |
| 4,871,304 | 10/1989 | Iida et al. | 418/220 |
| 4,872,820 | 10/1989 | Iida et al. | 418/220 |

FOREIGN PATENT DOCUMENTS

| | | | |
|---|---|---|---|
| 2-19684 | 1/1990 | Japan . | |
| 2-201077 | 9/1990 | Japan | 418/220 |

*Primary Examiner*—Richard E. Gluck
*Attorney, Agent, or Firm*—Limbach & Limbach

[57] ABSTRACT

An axial flow fluid compressor including a casing, a cylinder mounted in the casing, a rotary member arranged in the cylinder so as to extend along the axis of the cylinder and be eccentric to the cylinder and rotatable relative to the cylinder while part of the rotary member is in contact with the inner surface of the cylinder along a line longitudinal to the axes of the cylinder, the rotary member having a pair of spiral blades movable in the radial direction of the rotary member so as to define two sets of working chambers having volumes gradually decreasing from a suction-side to a discharge-side, a power transmission for relatively rotating the cylinder and the rotary member to successively transport a fluid introduced from the suction-side toward the dischage-side through the working chambers, a pair of bearings for supporting respective ends of the rotary member, and a pair of openings formed at the respective ends of the rotary member for applying the pressure of the fluid in the cylinder to the pair of bearings facing the respective ends of the rotary member.

1 Claim, 4 Drawing Sheets

AXIAL FLOW FLUID COMPRESSOR

FIELD OF THE INVENTION

The present invention relates generally to a fluid compressor, and more particularly, to an axial flow fluid compressor for compressing a refrigerant gas in a refrigeration cycle, etc.

BACKGROUND OF THE INVENTION

Recently a new type of fluid compressor, i.e., an axial flow fluid compressor, has been developed to seek for ease of fabrication and assembling, as well as to seek for a simple construction, a good sealing of refrigerant gas and a high efficiency of compressing. Of such axial flow fluid compressors one having two blades on a rotary member, as shown in FIG. 1, has been developed. The axial flow fluid compressor of FIG. 1, which has been developed by the same inventor of this application, is disclosed in the Japanese Patent Disclosure P02-19684 opened to public on Jan. 23, 1990.

In FIG. 1, the axial flow fluid compressor 1 includes a harmetically sealed casing 2, an electrical driving element, e.g. a motor 3 and a compressing element 4.

The casing 2 comprises a sleeve 2*a* having a base 2*b* unitarily closing one end of the sleeve 2*a*. The sleeve 2*a* securely fits therein a stator 3*a* of the motor 3, while the base 2*b* of the casing 2 secures a main bearing 7 thereto for rotatably supporting rotating members of the motor 3 and the compressing element 4. This results to make a prescribed compressing space in the cylinder 5.

The compressing element 4 comprises a cylinder 5 and a rotary member 11 with a columnar shape. The cylinder 5 is coaxially secured to the inner peripheral surface of the rotor 6 of the motor 3 so as to rotate together with the rotor 6. One end of the cylinder 5 is rotatably fitted on an outer peripheral surface of the main bearing 7 at a sufficiently sealed condition. Another end of the cylinder 5 is also rotatably fitted on an outer peripheral surface of a sub bearing 9 at a sufficiently sealed condition, the sub bearing 9 being suspended on a supporting plate 8. The supporting plate 8 is fitted on the open end of the sleeve 2*a*. Thus the cylinder 5 is rotatably supported its both ends by the main bearing 7 and sub bearing 9. The sub bearing 9 is fastened to the supporting plate 8 with screws 10 to avoid the sub bearing 9 being loosed from the supporting plate 8 during an assembling operation of the axial flow fluid compressor 1.

The cylinder 5 contains therein a rotary member 11 with a columner shape. The rotary member 11 is rotatably suspended at its two shaft ends 11*a*, 11*b* by the main bearing 7 and the sub bearing 9, respectively. That is, the shaft end 11*a* is rotatably fitted into a bearing hole 7*a* of the main bearing 7, while the other shaft end 11*b* is rotatably fitted into a bearing hole 9*a* of the sub bearing 9. The bearing hole 7*a* and the bearing hole 9*a* are eccentric from the axis of the cylinder 5 by a prescribed distance e. So that, the outer peripheral surface of the rotary member 11 partially contacts with the inner peripheral surface of the cylinder 5 along a line longitudinal to the axes of the rotary member 11 and the cylinder 5.

A power transmission mechanism 12 is coupled between the cylinder 5 and the rotary member 11 at the position near the sub bearing 9. The power transmission mechanism 12 drives the rotary member 11 when the cylinder 5 is driven by the motor 3, so that the rotary member 11 is caused a relative rotation in regard to the cylinder 5.

The outer peripheral surface of the rotary member 11 is defined a pair of spiral grooves G, G with a prescribed sectional shape, thus resulting the compressing element 4 to be functionally divided into two symmetrical compressing sections. Thus the compressing space in the cylinder 5 is also divided in two compressing sub-spaces The spiral grooves G, G turn in the opposite directions with each other, and their spiral pitches gradually narrow from the intermediate portion of the rotary member 11 along its axis toward its respective end portions. The spiral grooves G, G are provided therein with a pair of spiral blades B, B. The spiral blades B, B have sectional shapes and spiral pitches corresponding to those of the spiral grooves G, G. The spiral blades B, B are not only movable in the spiral grooves G, G in the radial direction of the rotary member 11, but also intimately contacts with the inner peripheral surface of the cylinder 5.

According to the arrangement of the compressing element 4, in each of the two symmetrical compressing sections the compressing sub-space in the cylinder 5 is further partitioned to a plurality of working chambers C by the cooperation of the spiral blade B and the longitudinal contact between the cylinder 5 and the rotary member 11. The volumes of the working chambers C decrease from the intermediate portion to the end portions of the rotary member 11, in proportion to the spiral pitch of the spiral groove G and the spiral blade B.

The bearing hole 7*a* of the main bearing 7 opens to an inlet tube 13 which is coupled to a refrigeration cycle (not shown), while the rotary member 11 is provided with an inlet opening 14 which elongates from the end of the shaft end 11*a* facing the inlet tube 13 to the outer peripheral surface of the rotary member 11 at the intermediate portion of the rotary member 11. Thus a refrigerant gas is introduced into the compressing space between the cylinder 5 and the rotary member 11 from the inlet tube 13 through the inlet opening 14. The refrigerant gas then separately propagates to the working chambers C of the two symmetrical compressing sections. The compressing element 4 is also provided with a pair of outlet openings 15, 15 on the respective ends of the cylinder 5. The outlet openings 15, 15 couple the outermost working chambers C to a buffer space defined between the compressing element 4 and the casing 2. Thus the refrigerant gas compressed by the compressing element 4 is discharged into the buffer space in the axial flow fluid compressor 1. The refrigerant gas is then discharged from the axial flow fluid compressor 1 to the refrigeration cycle through a discharge tube (not shown).

Now the operation of the axial flow fluid compressor 1 will be described. The motor 3 drives the cylinder 5 to rotate. The rotation of the cylinder 5 is transmitted to the rotary member 11 through the power transmission mechanism 12. When the rotary member 11 rotates in relative to the cylinder 5, each of the spiral blades B, B also rotates together with the rotary member 11. Since the outer surface of the spiral blade B intimately contacts with the inner peripheral surface of the cylinder 5, when a portion of the outer peripheral surface of the rotary member 11 is getting closer to the inner peripheral surface of the cylinder 5, a corresponding portion of the spiral blade B is depressed into the spiral groove G. On the other hand, when the portion of the outer peripheral surface of the rotary member 11 is getting far from the inner peripheral surface of the cylinder 5, the corresponding portion of the spiral blade B rises up in the spiral groove G.

On the other hand, a refrigerant gas is sucked into the axial flow fluid compressor 1 through the inlet tube 13. The refrigerant gas is then introduced to the intermediate portion of the compression space in the compressing element 4 through the inlet opening 14, so that in each of the two symmetrical compressing sections some amount of the refrigerant gas is locked in the working chamber C close to the intermediate portion. The working chamber C moves toward the end portion of the rotary member 11 along with the rotation of the rotary member 11, while the volume of the working chamber C decreases along with the movement of the working chamber C. As a result, the refrigerant gas in the working chamber C is compressed up to a prescribed pressure when the working chamber C reaches the position facing the outlet opening 15. the compressed refrigerant gas then discharged into the buffer space in the casing 2 through the outlet opening 15 of the cylinder 5.

The prior art axial flow fluid compressor described above, however has a problem of a pressure unbalance as follows. That is, the shaft end 11*a* facing the inlet tube 13 is subjected to the suction pressure of the refrigerant gas. While the other shaft end 11*b* facing the sub bearing 9 is subjected to the discharge pressure in the discharge space. The pressure difference between the suction pressure and the discharge pressure causes a thrust force against the rotary piston 11 in the direction from the sub bearing 9 to the main bearing 7. According to this thrust force, the shaft end 11*a* of the rotary member 11 presses against the main bearing 7. This causes a serious problem of poor lubrication in the bearing systems of the compressing element 4, especially in the main bearing 7. Furthermore, the axial flow fluid compressor 1 is reduced its compressing efficiency due to the thrust force.

Furthermore the prior art axial flow fluid compressor has a problem of that in the assembling process of the compressor the positioning of the compressing element in the casing is very difficult.

SUMMARY OF THE INVENTION

It is, therefore, an object of the present invention to provide an axial flow fluid compressor which is sufficiently free from a thrust force against its compressing member.

Another object of the present invention to provide an axial flow fluid compressor which has a good compression efficiency.

Still another object of the present invention to provide an axial flow fluid compressor which is easy to assemble.

In order to achieve the above object, an axial flow fluid compressor according to one aspect of the present invention has a casing, a cylinder mounted in the casing, a rotary member arranged in the cylinder so as to extend along the axis of the cylinder and be eccentric to the cylinder and rotatable relative to the cylinder while part of the rotary member is in contact with the inner surface of the cylinder along a line longitudinal to the axes of the cylinder, the rotary member having a pair of spiral blades movable in the radial direction of the rotary member so as to define two sets of working chambers having volumes gradually decreaseing from a suction-side to a discharge-side, a power transmission for relatively rotating the cylinder and the rotary member to successively transport a fluid introduced from the suction-side toward the discharge-side through the working chambers, a pair of bearings for supporting respective ends of the rotary member, and a pair of openings formed at the respective ends of the rotary member for applying the pressure of the fluid in the cylinder to the pair of bearings facing the respective ends of the rotary member.

Additional objects and advantages of the present invention will be apparent to persons skilled in the art from a study of the following description and the accompanying drawings, which are hereby incorporated in and constitute a part of this specification.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
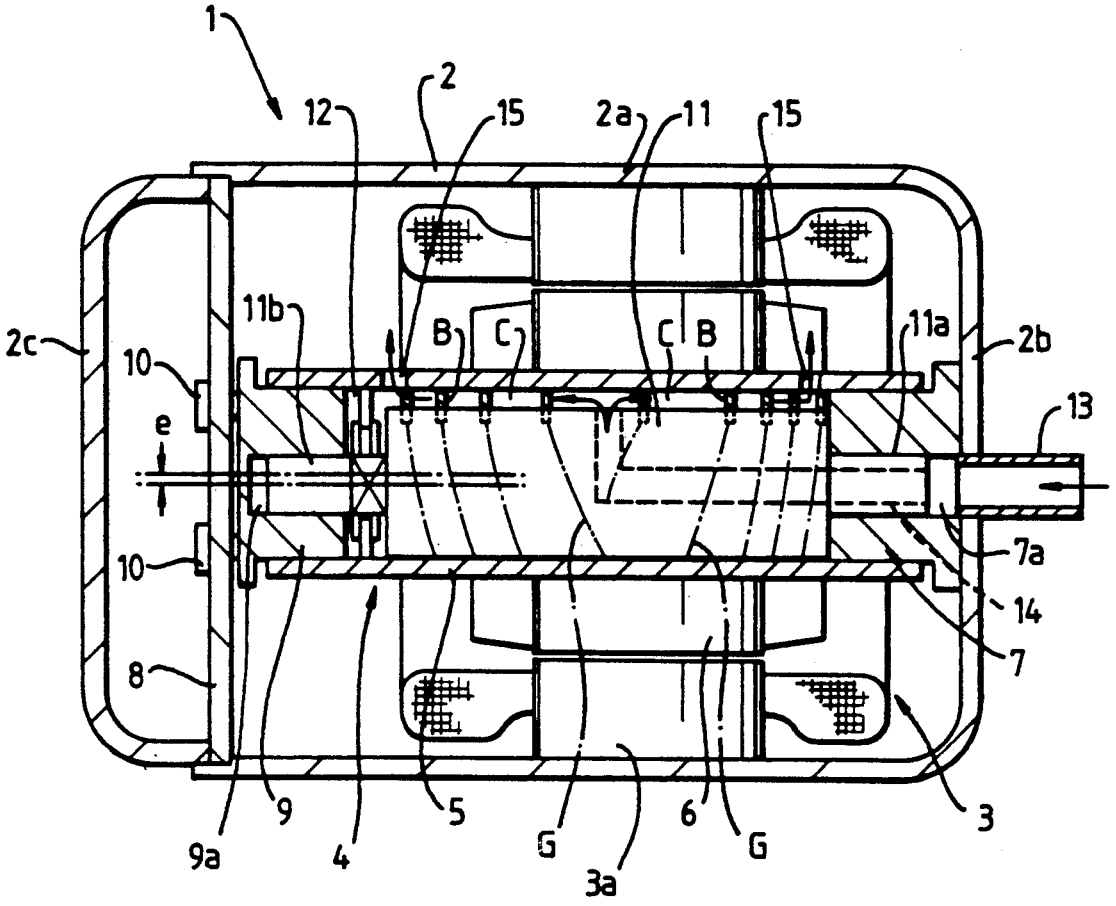
FIG. 1 ( Prior art )
FIG. 1 is a longitudinal section of a prior art axial flow fluid compressor.

The present invention will be described in detail with reference to the FIGS. 2 through 5. Throughout the drawings, like or equivalent elements as those in FIG. 1 will be designated with the same reference numerals or letters used in FIG. 1 for simplicity of explanation.

Figure 2:
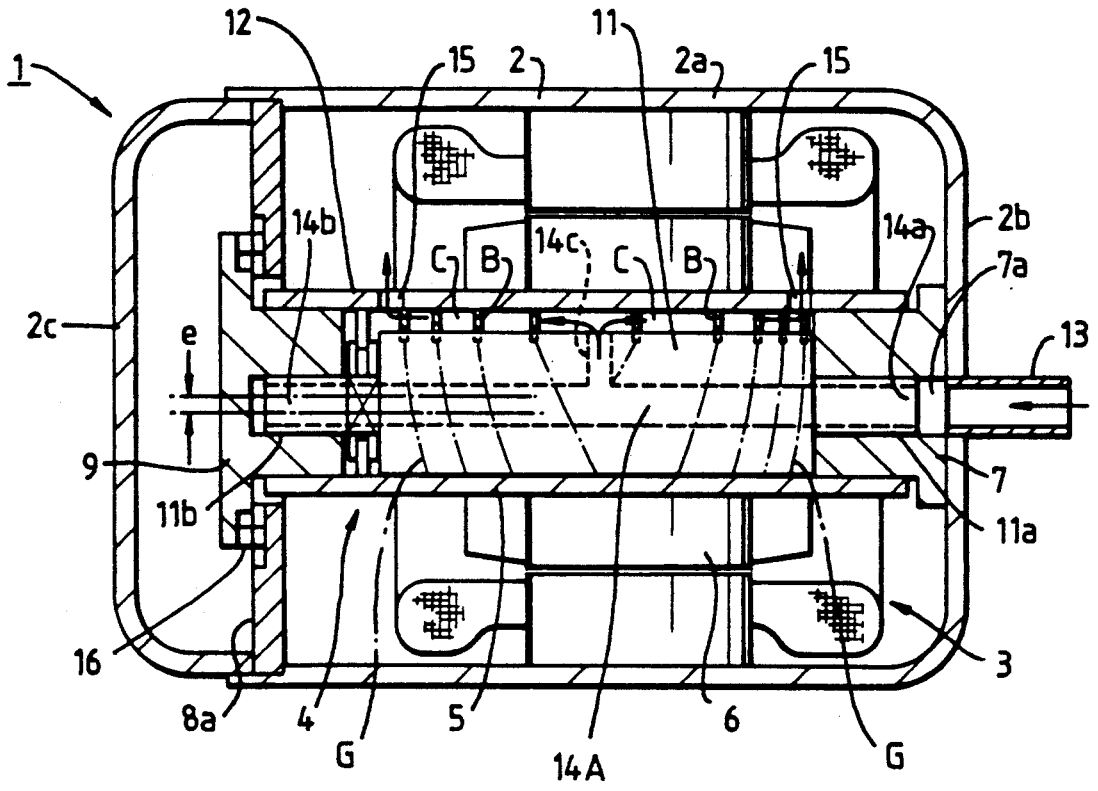
FIG. 2 is a longitudinal section of a preferred embodiment of the axial flow fluid compressor according to the present invention.
Figure 3:
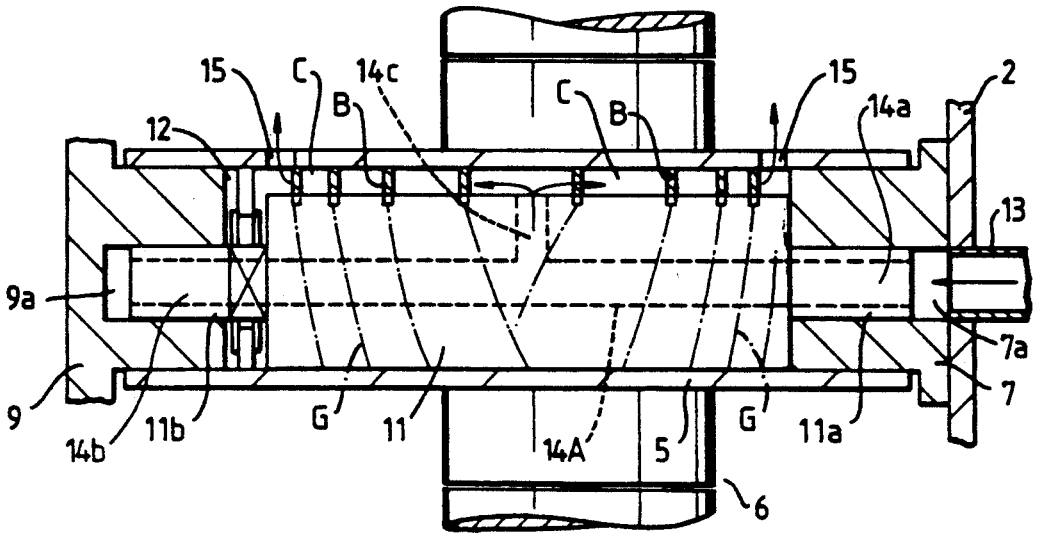
FIG. 3 is a partial cutaway of the of the compression section of the compressor shown in FIG. 2.
Figure 4:
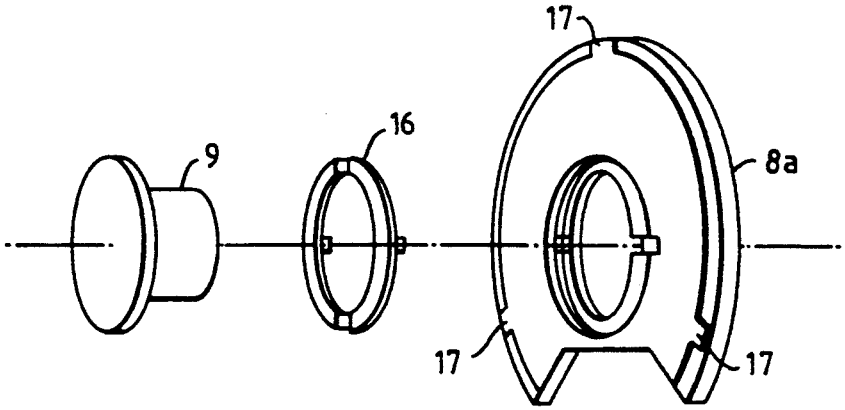
FIG. 4 is an exploded perspective view of the supporting system for the compression element in the axial flow fluid compressor.

Referring now to FIGS. 2 through 4, a first embodiment of the axial flow fluid compressor according to the present invention will be described in detail.

In FIG. 2, the axial flow fluid compressor 1 includes a harmetically sealed casing 2, an electrical driving element, e.g. a motor 3 and a compressing element 4, in similar to FIG. 1. Explanations for these and other elements like or equivalent as those in FIG. 1 will be generally omitted hereinafter, by reference to the explanation and the drawing of FIG. 1.

The rotary member 11 is provided with a refrigerant guide 14A which elongates from the shaft end 11*a* facing the inlet tube 13 to the other shaft end 11*b* facing the base of the bearing hole 9*a* of the sub bearing 9. Thus, the refrigerant guide 14A has two openings 14*a*, 14*b* facing to the bases of the main bearing 7 and the sub bearing 9. The refrigerant guide 14A further includes a branch 14*c* connecting the refrigerant guide 14A and the outer peripheral surface of the rotary member 11 at the intermediate portion of the compressing element 4. Thus, the refrigerant gas at the suction pressure from the inlet tube 13 is introduced not only to the working chamber C coupled to the intermediate portion of the cylinder 5, but also to the end space of the refrigerant guide 14A facing the sub bearing 9. The refrigerant gas locked in the working chamber C is then compressed in the same manner as the prior art axial flow fluid, while the refrigerant gas led to the end space facing the sub bearing 9 through the refrigerant guide 14A presses against the sub bearing 9 at the same pressure as the section pressure in the end space facing the main bearing 7.

As a result, both the shaft ends 11*a* and 11*b* are subjected to the same pressure of the refrigerant gas through the refrigerant guide 14A. Here the refrigerant guide 14A is designed to have the same diameter D at the respective ends of the shaft ends 11*a* and 11*b*, as shown in FIG. 3. Accordingly, the thrust forces against the shaft ends 11*a* and 11*b* cancel each other. This effects to avoid an undesired increase of friction loss between the main bearing 7 and shaft end 11*a*. Thus not only the lubrication between the main bearing 7 and the shaft end 11*a* is improved, but also the electrical load of the motor 3 for driving the compressing element 4 is reduced without being wasted due to the friction loss.

Figure 5:
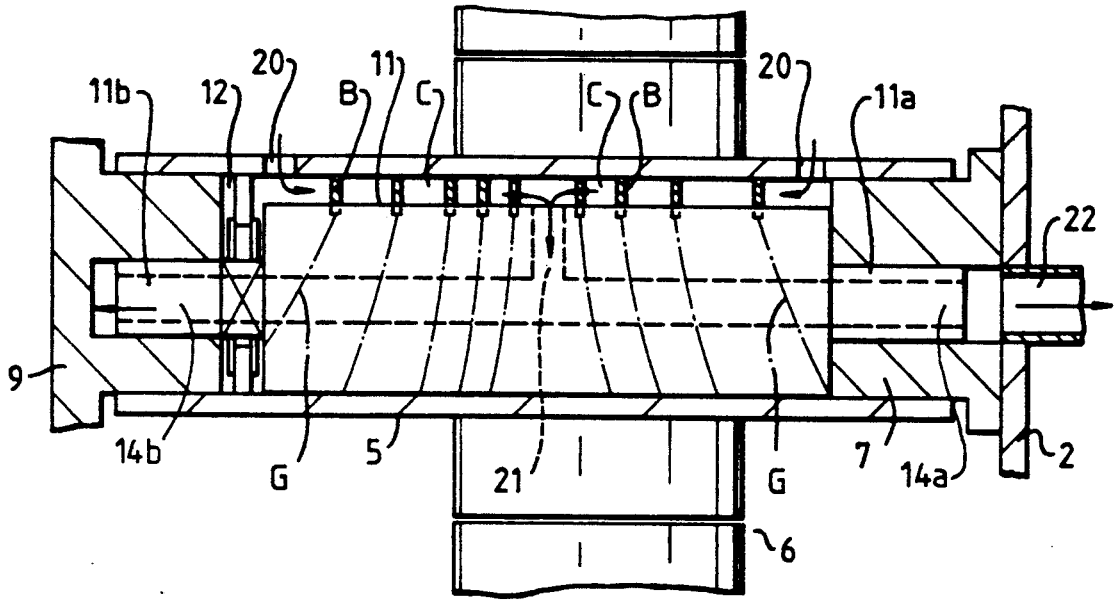
FIG. 5 is a partial cutaway of the of the compression section of the compressor according to another embodiment of the present invention.

Referring now to FIG. 4 and to FIG. 5, the sub bearing 9 for supporting the other shaft end 11*b* of the rotary member 11 is suspended to the supporting plate 8 through an Oldham mechanism.

In the assembling process of the axial flow fluid compressor 1, the casing 2 is placed upright. Then the main bearing 7, the motor 3, the cylinder 5, the rotary member 11 and the power transmission mechanism 12 are assembled into the casing 2 in the order. Here it is desirable that the main bearing 7, the motor 3, the cylinder 5, the rotary member 11 and the power transmission mechanism 12 are preassembled prior to insert in the casing 2. The supporting plate 8 is then fitted to the opening of the casing 2, so that the center hole of the supporting plate 8 faces the other shaft end 11*b* of the rotary member 11 in the compressing element 4. The sub bearing 9 is then fitted into the center hole of the supporting plate 8 through an Oldham ring 16. The center hole of the supporting plate 8 has a prescribed clearance for the sub bearing 9, so that the sub bearing 9 is able to move in the center hole of the supporting plate 8.

The supporting plate 8 is provided with, e.g., three pieces of recess 17 for engagement with corresponding bosses formed on the opening edge of the sleeve 2*a* so that the supporting plate 8 is prevented from the rotation in relative to the casing 2. The Oldham ring 16 is permitted to move in a prescribed lateral direction in relative to the supporting plate 8, while the sub bearing 9 is permitted to move in another lateral direction perpendicular to the moving direction of the Oldham ring 16 in relative to the Oldham ring 16. So that the sub bearing 9 is permitted to freely move in the center hole of the supporting plate 8, but restricted to rotate around its axis. According to this arrangement for supporting the sub bearing 9 in the axial flow fluid compressor 1 through the Oldham mechanism, the sub bearing 9 is able to be easily assembled in the axial flow fluid compressor 1. Furthermore the position of the sub bearing 9 is automatically adjusted so as to suitably keep the position of the compressing element 4 in the axial flow fluid compressor 1. This arrangement for supporting the sub bearing 9 is further advantageous not only to reduce an amount of fastening elements, but also to minimize the size of the axial flow fluid compressor 1. Finally the open end of the casing 2 is harmetically closed by a lid 2*c*.

In the above embodiment, the compressing element 4 operates to compress the refrigerant gas and to discharge the gas to the buffer space in the casing 2. However the compressing element 4 is able to first induce therein the refrigerant gas through the buffer space in the casing 2, and then directly discharge the compressed refrigerant gas outside the axial flow fluid compressor 1. FIG. 5 shows such an embodiment of the compressing element 4. In FIG. 5, the refrigerant gas is sucked into the compressing element 4 through inlet openings 20, 20. The refrigerant gases through the inlet openings 20, 20 are then locked in the outermost working chambers C which face the inlet openings 20, 20, respectively. The working chambers C move toward the intermediate portion of the rotary member 11 along with the rotation of the rotary member 11, while the volume of the working chamber C decreases along with the movement of the working chambers C. As a result, the refrigerant gases in the working chambers C are compressed up to a prescribed pressure when they reach the position of the branch 14*a*. The compressed refrigerant gases are then discharged into the refrigerant guide 14A through the branch 14*a*. The compressed refrigerant gas in the refrigerant guide 14A is then discharged outside the axial flow fluid compressor 1 through an outlet tube 22 which corresponds to the inlet tube 13 of the first embodiment. It is noted that the spiral pitches of the spiral blades B, B and the spiral grooves G, G gradually narrow from the respective end portions of the rotary member 11 toward the intermediate portion along the axis of the rotary member 11.

In the above embodiment, the refrigerant guide 14A has the same diameter D at the respective ends of the shaft ends 11*a* and 11*b*, as shown in FIG. 3. However refrigerant guide 14A is able to be designed to have slightly different diameters between the ends of the shaft ends 11*a* and 11*b*. For example, the diameter of the branch 14*a* at the end of the shaft end 11*a* is made slightly larger than the diameter at the end of the other shaft end 11*b*. According to this differentiation of the diameters of the branch 14*a*, a very weak thrust force occurs and presses the rotary member 11 against the main bearing 7. This arrangement of differentiating the diameter of the refrigerant guide 14A is advantageous to mechanically stabilize the rotary member 11, because if no thrust force occurring on the rotary member 11 the rotary member 11 unstably fluctuates along it axial direction. Further the thrust force for pressing the rotary member 11 against the main bearing 7 is reasonable in comparison to a thrust force for pressing the rotary member 11 against the sub bearing 9, because the base of the casing 2 supporting the main bearing 7 is generally made stronger than the supporting plate 8 supporting the sub bearing 9.

In the above embodiments, the refrigerant guide 14A operates as the passage for inletting or outletting the refrigerant gas to or from the compressing element 4. However the refrigerant guide 14A is able to be made apart from such a passage and then coupled to the passage for receiving the suction pressure or the discharge pressure.

The present invention is not limited to the application for the refrigeration cycle equipment. For example, it is applicable for fluid pumps.

As described above, the present invention can provide an extremely preferable fluid compressor.

While there have been illustrated and described what are at present considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation or material to the teaching of the present invention without departing from the central scope thereof. Therefore, it is intended that the present invention not be limited to the particular embodiment disclosed as the best mode contemplated for carrying out the present invention, but that the present invention include all embodiments falling within the scope of the appended claims.

What is claimed is:

1. An axial flow fluid compressor comprising:

a casing;

a cylinder mounted in the casing for defining a compressing space;

a columnar rotary member arranged in the cylinder so as to extend in the axial direction of the cylinder and be eccentric to the cylinder, and rotatable relative to the cylinder while part of the rotary member is in contact with the inner peripheral surface of the cylinder along a line longitudinal to the axis of the cylinder, the rotary member having a pair of spiral grooves on the outer peripheral surface thereof so as to define the compressing space into two symmetrical compressing sub-spaces each having a suction-side end and a discharge-side end, the spiral grooves having pitches narrowing gradually from the suction-side end toward the discharge-side end along the axial direction of the rotary member;

a pair of spiral blades each fitted in the corresponding spiral groove so as to be slidable in the radial direction of the rotary member, having an outer peripheral surface intimately in contact with the inner peripheral surface of the cylinder, and dividing the corresponding compressing sub-space into a plurality of working chambers having volumes gradually decreasing from the suction-side end to the discharge-side end in proportion to the spiral pitch of the blade;

driving means for relatively rotating the cylinder and the rotary member to successively transport a fluid introduced from the suction-side end toward the discharge-side end of the respective compressing sections through the working chambers;

a pair of bearing means for supporting respective ends of the columnar rotary member; and a pair of opening means, each having the same area, formed at the respective ends of the rotary member for applying the pressure of the fluid in the cylinder equally to the pair of bearing means facing the respective ends of the rotary member.

* * * * *